United States Patent [19]

Clegg

[11] 4,290,826

[45] Sep. 22, 1981

[54] PROCESS FOR THE PRODUCTION OF COBALT-RARE EARTH ALLOY POWDERS

[75] Inventor: Maurice A. Clegg, Fort Saskatchewan, Canada

[73] Assignee: Sherritt Gordon Mines Limited, Toronto, Canada

[21] Appl. No.: 192,408

[22] Filed: Sep. 30, 1980

[30] Foreign Application Priority Data

Oct. 12, 1979 [GB] United Kingdom ..... 35544/79

[51] Int. Cl.[3] ..... H01F 1/02

[52] U.S. Cl. ..... 148/101; 75/0.5 BA; 75/0.5 BC; 148/105; 148/126; 252/62.55

[58] Field of Search ..... 148/101, 105, 126; 75/0.5 BA, 0.5 BB, 0.5 AC, 0.5 BC; 252/62.55

[56] References Cited

U.S. PATENT DOCUMENTS

| | | | |
|---|---|---|---|
| 3,540,945 | 11/1970 | Strnat | 75/170 |
| 3,625,779 | 12/1971 | Cech | 148/101 |
| 3,690,963 | 9/1972 | Spink | 148/126 |
| 3,741,748 | 6/1973 | Fustukian et al. | 75/0.5 AC |
| 3,826,696 | 7/1974 | Cech | 148/105 |
| 3,928,089 | 12/1975 | Cech | 148/105 |
| 4,010,025 | 3/1977 | Fraioli et al. | 75/0.5 AC |

OTHER PUBLICATIONS

"Sintering of Die-Pressed $Co_5Sm$ Magnets", *Journal of Applied Physics,* vol. 41, No. 13, Dec. 1970, pp. 5247–5249, Cech.

*Primary Examiner*—L. Dewayne Rutledge
*Assistant Examiner*—John P. Sheehan
*Attorney, Agent, or Firm*—Robert F. Delbridge; Arne I. Fors

[57] ABSTRACT

A process for producing cobalt-rare earth alloy powders suitable for forming into permanent magnets includes mixing cobalt powder particles having refractory oxide dispersoid powder particles fixed in the surfaces of the cobalt particles with particles of a rare earth element in a proportion corresponding to the composition of the alloy to be formed. The mixture is heated to cause the cobalt-dispersoid particles and the rare earth particles to form the desired alloy by diffusion with substantially no sintering.

16 Claims, No Drawings

PROCESS FOR THE PRODUCTION OF COBALT-RARE EARTH ALLOY POWDERS

The present invention relates to the production of cobalt-rare earth alloy powders.

It is known that powdered alloys of cobalt and certain rare earth elements can be utilized to form permanent magnets with desirable properties such as high coercive force, that is to say stability against demagnetization, since such powdered alloys have extremely high magnetocrystalline anisotropy, see for example U.S. Pat. No. 3,540,945 issued Nov. 17, 1970. According to this prior patent, desired amounts of the two components, namely cobalt and the rare earth element, are melted together under a protective noble gas atmosphere or under a vacuum, and the resulting alloy is then crushed and thereafter ground to powder in a ball mill or a vibratory mill. However, it has been found that such grinding causes permanent magnets produced from such ground alloys to have a lower coercive force than might otherwise be expected.

In an attempt to overcome this disadvantage, it has been proposed to subject a mixture of cobalt powder and rare earth powder in suitable proportions to diffusion heat treatment, see for example, the Paper entitled "Sintering of Die-Pressed $Co_5Sm$ Magnets" by R. E. Cech in the Journal of Applied Physics, Volume 41, No. 11, December, 1970. However, a disadvantage of this proposal is that at temperatures high enough to effect the required alloying, substantial sintering occurs, with the result that grinding is still required, with the same disadvantage as before.

The present invention is based on the discovery that, not only can such sintering be substantially prevented, but also the structural properties, including possibly the magnetic properties, of a permanent magnet formed from the powder are stabilized if particles of a refractory oxide dispersoid powder are fixed in the cobalt particle surfaces before the diffusion heat treatment is carried out. In this way, stabilized permanent magnets with a relatively high intrinsic coercive force can be produced.

Accordingly, the present invention provides a process for producing cobalt-rare earth alloy powders suitable for forming into permanent magnets, including providing cobalt powder particles having refractory oxide dispersoid powder particles fixed in the surfaces of the cobalt particles, providing particles of a rare earth element, mixing the cobalt-dispersoid particles with the rare earth particles in a proportion corresponding to the composition of the alloy to be formed, and heating the mixture to cause the cobalt-dispersoid particles and the rare earth particles to form the desired alloy by diffusion with substantially no sintering.

The absence of sintering preserves the fine particle size necessary for small particle magnetization. Further, it is believed that the presence of the refractory oxide dispersoid in the permanent magnet prevents or at least reduces nucleation and/or motion of Bloch (domain) walls which would cause a reversal of magnetization.

Permanent magnets can be formed from the powder by powder metallurgy techniques, for example by resin bonding or by isostatic compaction and sintering.

Preferably, the cobalt powder has a particle size in the range of from about 0.2 to about 5 micrometers and the refractory oxide dispersoid powder has a particle size in the range of from about 1 to about 20 nanometers, with the proportion of dispersoid particles to cobalt particles being from about 0.5 to about 2% by weight. The refractory oxide dispersoid is preferably thoria or yttria.

The rare earth element may be samarium or misch metal, which is a mixture of rare earth elements, and the rare earth particles preferably have a size in the range of from about 5 to about 44 micrometers.

The cobalt-dispersoid particles are mixed with the rare earth particles in a proportion corresponding to the composition of the alloy to be formed, with the alloy preferably being $Co_5Sm$ or $Co_{17}Sm_2$, and the mixture is heated, preferably at a temperature in the range of from about 980° to about 1100° C., to cause the cobalt-dispersoid particles and the rare earth particles to form the desired alloy by diffusion with substantially no sintering occurring.

An example of the invention in which $Co_5Sm$ powder was produced will now be described.

Very fine cobalt powder with a particle size of about 1 micrometer and with about 0.5% by weight of thoria particles fixed in the cobalt particle surfaces was provided, the thoria particles having a size of about 10–20 nanometers. Such powder was produced in the manner described in U.S. Pat. No. 3,741,748 issued June 26, 1973, which provided a fine and uniform dispersion of thoria in the cobalt particles.

The cobalt-thoria particles were mixed with samarium powder with a particle size of about 44 micrometers in approximately the stoichiometric weight ratio for $Co_5Sm$, the weight of cobalt-thoria powder to samarium powder thus being about 2:1. The mixture was then treated for about 2 hours at a temperature of about 1040° C. in a vacuum of about $10^{-5}$ mm Hg to cause the samarium to alloy with the cobalt by diffusion.

It was found that little or no sintering occurred and that, even if some light sintering did occur, the lightly sintered cake could be broken up very easily. X-ray diffraction and/or electron microprobe analysis was used to identify the product as $Co_5Sm$.

Permanent magnets were produced from this powder by isostatic compaction and sintering for about 1 hour at about 1040° C. in a vacuum of about $10^{-5}$ mm Hg. One such magnet in the form of a small rod 3/16 inch in diameter and ¼ inch in length was magnetized in a magnetic field of 5 kOe, as measured by a vibration sample magnetometer. With a similar magnet, a magnetizing field of about 35 kOe was used, and an intrinsic coercive force of about 5.5 kOe was obtained.

Since no magnetic alignment of $Co_5Sm$ product particles was carried out before the powder was formed into permanent magnets in the above mentioned tests, the intrinsic coercive forces obtained are relatively high and indicate an advantage of the present invention.

Other embodiments and examples of the invention will be readily apparent to a person skilled in the art, the scope of the invention being defined in the appended claims.

What I claim as new and desire to protect by Letters Patent of the United States is:

1. A process for producing cobalt-rare earth alloy powders suitable for forming into permanent magnets, including providing cobalt powder particles having refractory oxide dispersoid powder particles fixed in the surfaces of the cobalt particles, providing particles of a rare earth element, mixing the cobalt-dispersoid particles with the rare earth particles in a proportion corresponding to the composition of the alloy to be formed, and heating the mixture to cause the cobalt-dispersoid particles and the rare earth particles to form the desired alloy by diffusion with substantially no sintering.

2. A process according to claim 1 wherein the cobalt particles are of a size in the range of from about 0.2 to about 5 micrometers.

3. A process according to claim 2 wherein the refractory oxide dispersiod powder particles are of a size in the range of from about 1 to about 20 nanometers.

4. A process according to claim 1 wherein the refractory oxide dispersoid powder particles are present in the cobalt-dispersoid particles in the proportion of from about 0.5 to about 2% by weight of the cobalt particles.

5. A process according to claim 1 wherein the rare earth element particles are of a size in the range of from about 5 to about 44 micrometers.

6. A process according to claim 1 wherein the refractory oxide dispersoid is thoria.

7. A process according to claim 1 wherein the refractory oxide dispersoid is yttria.

8. A process according to claim 1 wherein the rare earth element is samarium.

9. A process according to claim 1 wherein the rare earth element is misch metal.

10. A process according to claim 1 wherein the mixture is heated at a temperature in the range of from about 980° C. to about 1100° C.

11. A process according to claim 1 wherein the alloy formed is $Co_5Sm$.

12. A process for producing cobalt-rare earth alloy powders suitable for forming into permanent magnets, including providing cobalt powder particles with a particle size in the range of from about 0.2 to about 5 micrometers and with refractory oxide dispersoid powder particles fixed in the surfaces of the cobalt particles, said refractory oxide dispersoid powder particles having a size in the range of from about 1 to about 20 nanometers, the proportion of dispersoid particles to cobalt particles being from about 0.5 to about 2% by weight of the cobalt particles, providing particles of a rare earth element having a size in the range of from about 5 to about 44 micrometers, mixing the cobalt-dispersoid particles with the rare earth particles in a proportion corresponding to the composition of the alloy to be formed, and heating the mixture to cause the cobalt-dispersoid particles and the rare earth particles to form the desired alloy by diffusion with substantially no sintering.

13. A process according to claim 12 wherein the refractory oxide dispersoid is thoria.

14. A process according to claim 12 wherein the rare earth element is samarium.

15. A process according to claim 14 wherein the alloy formed is $Co_5Sm$.

16. A process according to claim 12 wherein the mixture is heated at a temperature in the range of from about 980° C. to about 1100° C.

* * * * *